US005660287A

United States Patent [19]

Tryon

[11] Patent Number: 5,660,287

[45] Date of Patent: Aug. 26, 1997

[54] DISPLAY GONDOLA ASSEMBLY

[75] Inventor: John Frederick Tryon, Houston, Tex.

[73] Assignee: Shell Oil Company, Houston, Tex.

[21] Appl. No.: 533,419

[22] Filed: Sep. 25, 1995

Related U.S. Application Data

[63] Continuation-in-part of Ser. No. 511,317, Aug. 4, 1995, abandoned.

[51] Int. Cl.[6] ..... A47B 47/00; A47B 57/00; A47F 5/00

[52] U.S. Cl. ..... 211/186; 211/187; 211/189; 211/190

[58] Field of Search ..... 211/189, 190, 211/186, 187, 94, 94.5

[56] References Cited

U.S. PATENT DOCUMENTS

| | | | |
|---|---|---|---|
| 2,991,889 | 7/1961 | Levy et al. | 211/190 |
| 3,353,684 | 11/1967 | Chesley | 211/187 |
| 3,877,395 | 4/1975 | Sobel | 211/186 X |
| 4,138,019 | 2/1979 | Smith | 211/190 X |
| 4,785,946 | 11/1988 | Sorensen | 211/189 X |
| 4,860,812 | 8/1989 | DePietro et al. | 211/189 X |
| 5,185,971 | 2/1993 | Johnson, Jr. | 211/94 X |
| 5,205,421 | 4/1993 | Bustor | 211/187 X |
| 5,472,103 | 12/1995 | Merl | 211/190 X |
| 5,477,971 | 12/1995 | Howard | 211/189 X |
| 5,529,192 | 6/1996 | Conen et al. | 211/189 |

OTHER PUBLICATIONS

Brochure: PDM Molding, Inc.

Brochure: Applications for Rotational Molding.

*Primary Examiner*—Leslie A. Braun

*Assistant Examiner*—Donald J. Wallace

[57] ABSTRACT

The invention includes a molded gondola assembly for display of supplies or retail stock, the gondola assembly including one or more typically at least two gondola units: where the gondola units are abutted side by side; and where one side of one gondola unit abuts one side of the abutted gondola unit, where each gondola unit includes: an inner polymeric panel surface; an outer polymeric panel surface; where the inner and outer panel surfaces are integrally joined and formed by molding; where the inner and outer panel surfaces form a plurality of integrally joined panels; and where the panels include: a substantially vertical panel having a top and bottom portion, having a front and back portion, the front portion configured to receive shelves or hooks for displaying or storing supplies or retail goods; a substantially horizontal panel having a front and back portion, having a top and bottom portion, the bottom portion for contacting the floor; where the bottom portion of the vertical panel is integrally joined with the back portion of the horizontal panel, thus forming an L-shaped assembly; where the vertical panel further includes a plurality of integrally formed ribs extending vertically from a top portion to a bottom portion of the vertical panel, the ribs for providing structural strength to the vertical panel.

7 Claims, 9 Drawing Sheets

SHARED SHELF STANDARD MOUNTING

INTERMEDIATE SHELF STANDARD MOUNTING

END SHELF STANDARD MOUNTING

DISPLAY GONDOLA ASSEMBLY

RELATED APPLICATIONS

This application is a continuation-in-part of patent application Ser. No. 08/511,317, filed Aug. 4, 1995, entitled "Display Gondola Assembly" now abandoned.

FIELD OF THE INVENTION

The invention relates to a polymeric gondola assembly for storing and/or displaying supplies or retail stock.

BACKGROUND OF THE INVENTION

Retail stores have a need for many types of storage, display, and serving fixtures and areas for the retail goods. Goods must be visibly displayed for the customer's easy access. Extra inventory must be stored until needed.

Such needs are present, for example, in convenience stores. Such a display apparatus, s ideally requires only low maintenance, has a long life, and can be readily installed in a variety of floor plan configurations. It should also be movable when loaded. The "gondola" is typically used in convenience stores for display of merchandise. The term "gondola" is the term used in the convenience store trade for a vertically standing display rack or assembly capable of holding several shelves or hooks for displaying merchandise, These can be assembled back to back and end to end to create walking aisles in a convenience store where merchandise is displayed on both sides of the aisle:

Existing gondola construction materials are carbon steel, aluminum, pressed hard board, and wire space frame systems. Each and every current design takes considerable time to install, and cannot be readily moved when fully loaded. Steel and pressed hard board have the disadvantages of being heavy, being manpower intensive for assembly, being susceptible to chipping and scratching of the painted surface, having assembly difficulties due to non-uniform parts, and being difficult or impossible to move after assembled and loaded.

Accordingly, there is an immediate need for a new light weight, one piece, structurally sound merchandising gondola which can be used in all retail facilities, libraries, schools, colleges, universities, hospitals, general stores, grocery stores, and other like facilities.

A modular design is desirable so as to reduce manufacturing cost. A single piece basic gondola unit is desirable to reduce assembly problems and to eliminate the irregularities which arise when each gondola unit requires separate assembly. The gondola should be made of an inexpensive material that is durable, easily cleaned, and of light weight. The present invention addresses all of the above problems and provides a gondola assembly to meet the above discussed needs.

SUMMARY OF THE INVENTION

The invention includes a molded gondola assembly for display of supplies or retail stock, the gondola assembly including one or more, typically at least two, gondola units: where the gondola units are abutted side by side; and where one side of one gondola unit abuts one side of the abutted gondola unit, where each gondola unit includes: an inner polymeric panel surface; an outer polymeric panel surface; where the inner and outer panel surfaces are integrally joined and formed by molding; where the inner and outer panel surfaces form a plurality of integrally joined panels; and where the panels include: a substantially vertical panel having a top and bottom portion, having a front and back portion, the front portion configured to receive shelves or hooks for displaying or storing supplies or retail goods; a substantially horizontal panel having a front and back portion, having a top and bottom portion, the bottom portion for contacting the floor; where the bottom portion of the vertical panel is integrally joined with the back portion of the horizontal panel, thus forming an L-shaped assembly; where the vertical panel further includes a plurality of integrally formed ribs extending vertically from a top portion to a bottom portion of the vertical panel, the ribs for providing structural strength to the vertical panel.

DETAILED DESCRIPTION OF THE PREFERRED EMBODIMENTS

A. Overview and Benefits

Figure 1:
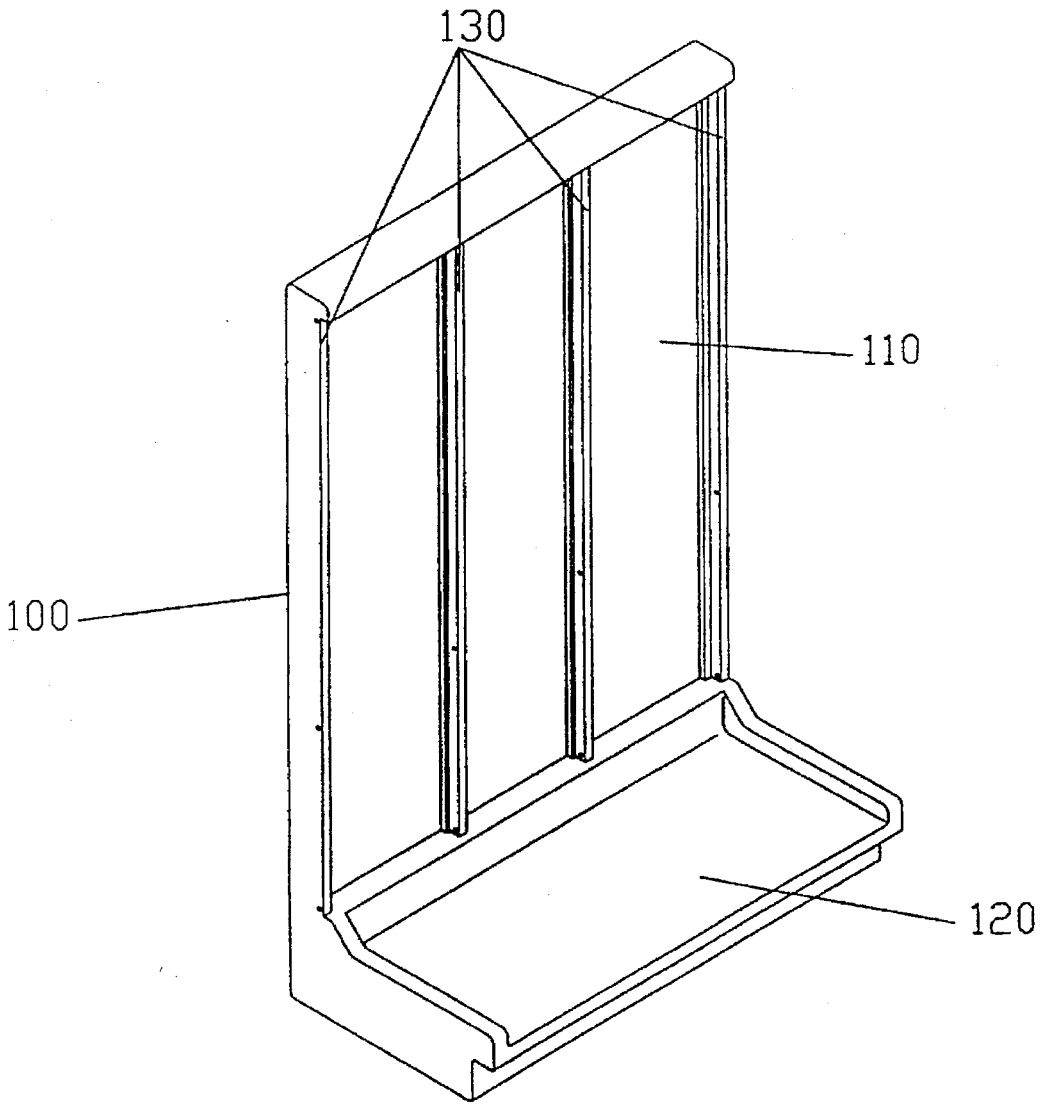
FIG. 1 shows a front/side isometric view of one embodiment of a single gondola unit.

This design of the invention is completely self-supporting and can utilize any and all known available hardware.

The invention has been designed to be quickly installed without any instruction or plans. It is very easy to mass produce with only one tool, i.e., a mold. In one manufacturing embodiment, an average of 48-plus units can readily be manufactured in a 24 hour period. In contrast, metal and wood gondolas currently on the market can take several days to manufacture one complete section.

Directly due to its one piece simple system and design, the gondola of this invention requires considerably less than known gondolas in time/cost to manufacture, time/cost to install, and time/cost/ease of combining with other merchandise materials and equipment. The gondola of the invention is very light weight yet very durable and sturdy. Typically, in one embodiment, it is capable of supporting without any deflection, 500 pounds of live load. It has a relatively narrow foot print, yet will not topple due to off center loading. The unit will also readily complement other merchandise cabinets, shelves, and other display furnishings.

The dimensions of the gondola are not limited. Various heights, widths, and depths are possible. A too high a ratio of height to width and/or height to depth will result in unstability. Determining the suitable height to width and depth ratios based on the loading expected and weight and strength of materials and other appropriate factors involved utilizes conventional structural engineering principles. The unit of the invention, in one embodiment, is about 36 inches wide×18 inches deep at the base, i.e. for the horizontal panel and about 54 inches in overall height, i.e., of the vertical panel. The maximum number of shelves in one embodiment that the unit can properly support at any given time is about 10 depending on the combined weight of the merchandise and shelves. The usual number of shelves for one unit is 6–7.

The strong back of the gondola will support horizontal shelves, angled shelves, wire shelves and baskets, flat wall with brackets, peg board and peg brackets, etc. Shelves may be carbon steel, composition, press board, wire, and plastic. The shelving supports fastened to the structural ribs may be carbon steel, aluminum, or composition material.

Display cases known to the industry and readily available may be used and readily fastened to the gondola strong back. Example display cases include those with numerous small drawers for merchandising hardware, etc. Shelving and merchandising display are not limited in any manner when using the new gondola.

The gondola base will typically contain four screw adjusting feet which can be used to accommodate uneven floor surfaces. Each adjusting foot typically has a range of 4 inches vertically.

Another beneficial feature of the invention is the one piece construction which can be readily moved even when fully loaded. This is directly due to the fact that the unit is rigid and will not significantly deflect even when loaded. This greatly facilitates improved operation of the facility utilizing this new design.

The unit can be combined in lengths, placed back to back, placed under large merchandising windows, used as end caps, etc. A very unique feature is that the new plastic gondola can readily be sawed off if too high and a cap can be glued on the remaining top potion. A truncated vertical panel results when the recital panel is sawed or otherwise cut or shortened from its molded height. This allows the use of one mold for producing gondolas of various dimensions and uses.

The gondola assembly of the invention is designed to provide display and storage areas for merchandise and for extra goods and supplies or otherwise for general storage/surface needs. Such uses are practical for example in convenience stores, homes, hospitals, retail stores, laundries, cafeterias, and/or restaurants. The design is modular, meaning there is a common single gondola unit. The side walls, floor, and back of each gondola unit is a single piece, self-supporting design requiring no assembly and providing little or no deviation in dimensions between each gondola unit.

These gondola units can be adjoined or abutted side by side to construct a gondola assembly of the necessary size for any particular store floor plan. A single piece design also facilitates easy installation and removal or replacement of individual gondola units. Installation and removal can be done without tools, excluding adjustment of the adjustable footings.

The invention is opaque pigmented plastic and will not show scratches as is the current continuous problem in using steel, prefinished surfaces, laminates, etc. The unit overall light weight allows the operator to move the system without having to completely remove all merchandise, etc.

Shelving support members, e.g., typically vertical metallic brackets, may be attached to the ribs and changed to fit any known shelving bracket. The combined end cap vertical bracket also acts as a tie piece for the adjoining unit. The top of the gondola can readily be used for supporting signage within the molded system or directly on top of the top rail. The new gondola is designed to readily meet all ADA requirements.

The unit greatly resists stains, will not dent, will not tear, will not separate at the intersection of vertical back and horizontal bottom. The color of the unit is consistent throughout. If a hole is punched into the system it can readily be repaired and will not reduce the overall structural strength or diminish its structural capability.

The unit does not peel, fade chip, caulk, etc. It is very easy to cut and modify with common hand tools. The unit does not require any special hand or power tools to assemble. It does not need assembling, it is already assembled. The unit can accommodate any graphics in any size.

B. The Components

The gondola assembly includes the following components.

1. Abutting Gondola Units

The gondola assembly typically includes at least two gondola units. The gondola units are abutted side by side or are optionally fixedly adjoined side by side. One side of one gondola unit abuts one side of the other abutting gondola unit. Other arrangements are possible for multiple gondola units. These include back-to-back and triangular arrangements. Triangular or square arrangements provide storage space in the center of the triangle/square. For this purpose one or more gondola units can be on rollable casters for ease of movement for access to the storage area.

2. Gondola Unit Design

Each gondola unit includes an inner polymeric panel surface and an outer polymeric panel surface. These inner and outer polymeric surfaces are either separate polymeric shells or inner and outer wall surfaces of a single polymeric panel. This will depend on the method of manufacture. Rotational molding, discussed in more detail below is a preferred molding technique for this invention. Rotational molding can be used to produce single or double-walled construction. Double-wall rotational molding, typically, results in separate shells with a lower-density "foam" polymer in between; whereas Reaction Injection Molding, "RIM," results in a single wall panel, optionally, of substantially consistent density both at its inner and outer surfaces and in between the inner and outer surfaces. For further information, RIM is described at 14 Encyclopedia of Polymer Science and Engineering 75 (2nd Ed. 1988). The inner and outer panel surfaces are integrally joined and formed by molding, such as by rotational molding or other molding processes. The inner and outer panel surfaces are typically separated by a distance of from about 0.5 inch to about one inch and the inner panel surface is typically substantially parallel to the corresponding outer panel surface. The inner and outer panel surfaces form a plurality of integrally joined panels.

3. Panels

The panels include a vertical panel for displaying merchandise and a horizontal panel for contact with the floor. The bottom panel may optionally have threadably adjustable footings attached thereto for leveling the gondola assembly on an uneven floor surface. The vertical panel optionally has integral ribs along its front portion and integral indents along its back portion, both for providing structural strength. The horizontal panel optionally has a recessed kick panel along its front portion. This is an indented portion at the lowest part of the front portion of the horizontal panel. This prevents, to some extent, wear and marking to the horizontal panel from "kicks" from a customer's shoes. Also, since the area is indented and is visibly obscured, marks are less visible to the public than if the kick area was flush rather than indented.

4. Vertical Panel Indents/Ribs

The vertical panel of the gondola unit typically has ribs along its front portion and indents on its back portion. Both provide structural support to the vertical panel. The ribs also provide a place for attaching shelving support members. The substantially vertical panel is from about 48 inches to about 60 inches in height and about 30 inches to about 42 inches in width.

5. Horizontal Panel

A substantially horizontal panel is integrally formed with the vertical panel. The horizontal panel contacts the floor. The horizontal panel has dimensions of from about 12 inches to about 24 inches in depth and from about 30 inches to about 42 inches in width.

6. Peg Boards

Peg boards for displaying merchandise are optionally attached to the front portion of the vertical panel. Typically, the shelving support members will have flanges allowing threadable attachment of the peg boards to the flanges. A peg board has multiple holes along its surface for receiving wire or plastic hooks for hanging merchandise for display.

7. Shelves

One or more shelves are optionally removably attached to shelving support members which are attached to the ribs on the front portion of the vertical panels. The shelves are attached by any conventional means. Typically, horizontal shelf braces will connect to slots in the shelving support members. Shelves are then placed on the horizontal shelf braces.

C. Molding

The gondola unit is manufactured by molding. This includes rotational molding, RIM molding, and structural foam molding. Generally, rotational molding involves injection of a powdered or liquid state polymer into a mold. The mold is then heated and rotated around several axes to distribute the powdered polymer. Due to the heating, the powdered polymer melts and flows together along the mold thus forming panels conforming to the shape of the mold. A "foam" (i.e., less dense) polymer can optionally be added between the inner and outer panels. The foam can be a separate material from the panels and it can be injected. Alternatively, the "foam" can be formed of the same material as the inner and outer panels. In this process, before all the initial polymer is heat set to form the inner and outer panels, an appropriate chemical additive is injected into the unset polymer which causes it to "foam" and set. For further information, rotational molding is described at 14 Encyclopedia of Polymer Science and Engineering 659–670 (2nd Ed. 1988). Other conventional molding techniques are optionally used to manufacture the gondola assembly of the invention. These include vacuum/pressure forming, injection molding, blow molding compression forming, and match die forming.

D. Assembly and Installation

Various steps may be used in assembling and installing the gondola assembly. Typically, the desired number of gondola units are placed in the proper location in the store. They are positioned side by side. Optionally, they may be fixedly attached to each other at the abutting sides. The adjustable footings are then adjusted to account for any unevenness in the flooring. A single lower kick panel is then optionally installed at the bottom front portion of the bottom panels. Typically, no kick panel is installed since that would need to be removed before rearranging the gondolas. A cap member is optionally placed over the top portion of vertical panels. This can be used to support advertising placards or to give a uniform appearance to the top portions of multiple abutted gondolas.

DETAILED DESCRIPTION OF THE DRAWINGS

A. FIG. 1

FIG. 1 shows a front/side isometric view of one embodiment of a single gondola unit 100. Vertical panel 110 is integrally connected at its lower portion with horizontal panel 120 at its back portion. Ribs 130 are integrally formed in vertical panel 110.

B. FIG. 2

Figure 2:
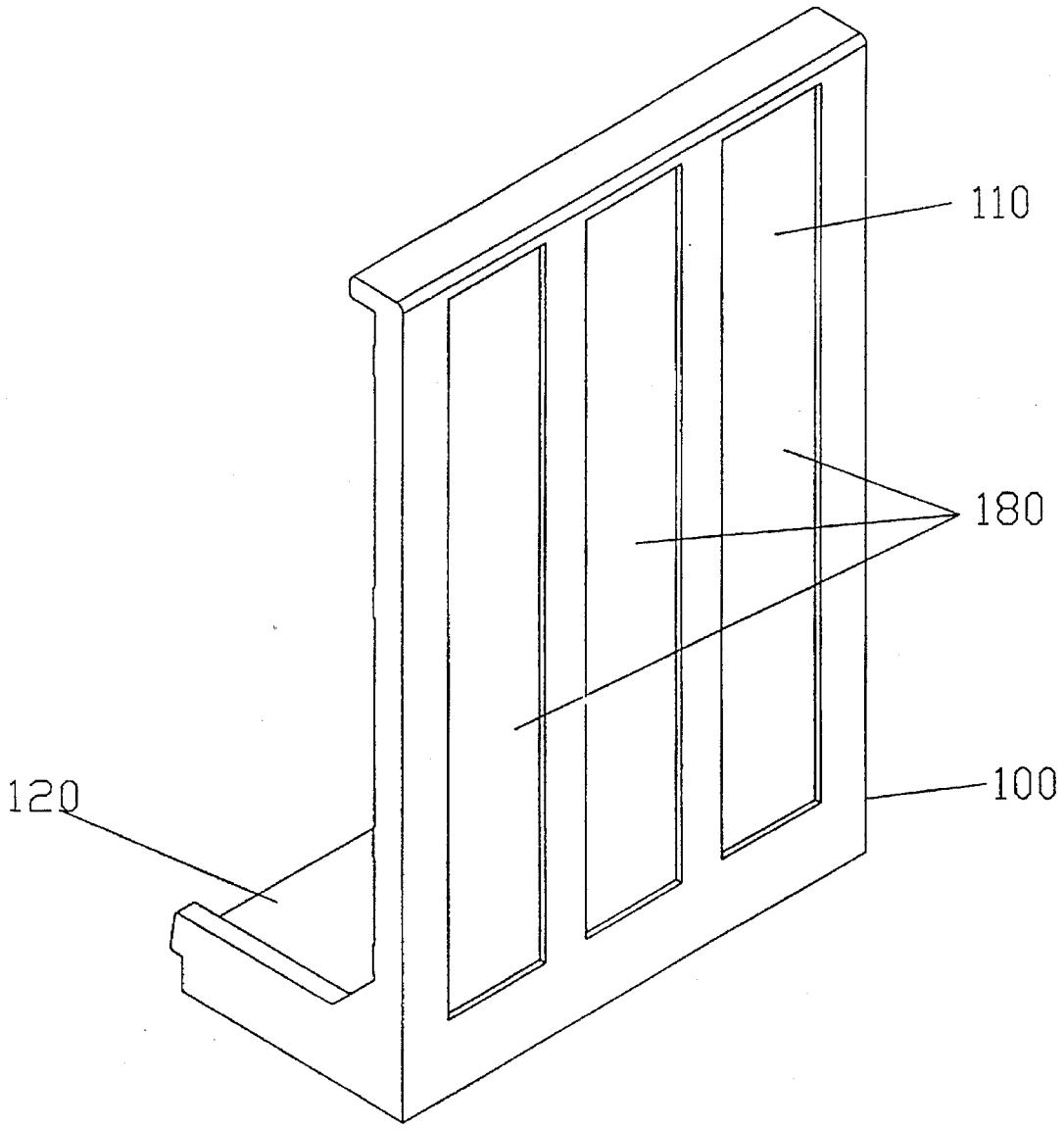
FIG. 2 shows a back/side isometric view of one embodiment of a single gondola unit.

FIG. 2 shows a back/side isometric view of one embodiment of a single gondola unit 100. The description is the same as for FIG. 1 except that ribs 130 on the front portion of vertical panel 110 are not visible from this back view. Integrally formed indents 180 in the back portion of vertical panel 110 provide additional structural support.

C. FIG. 3

Figure 3:
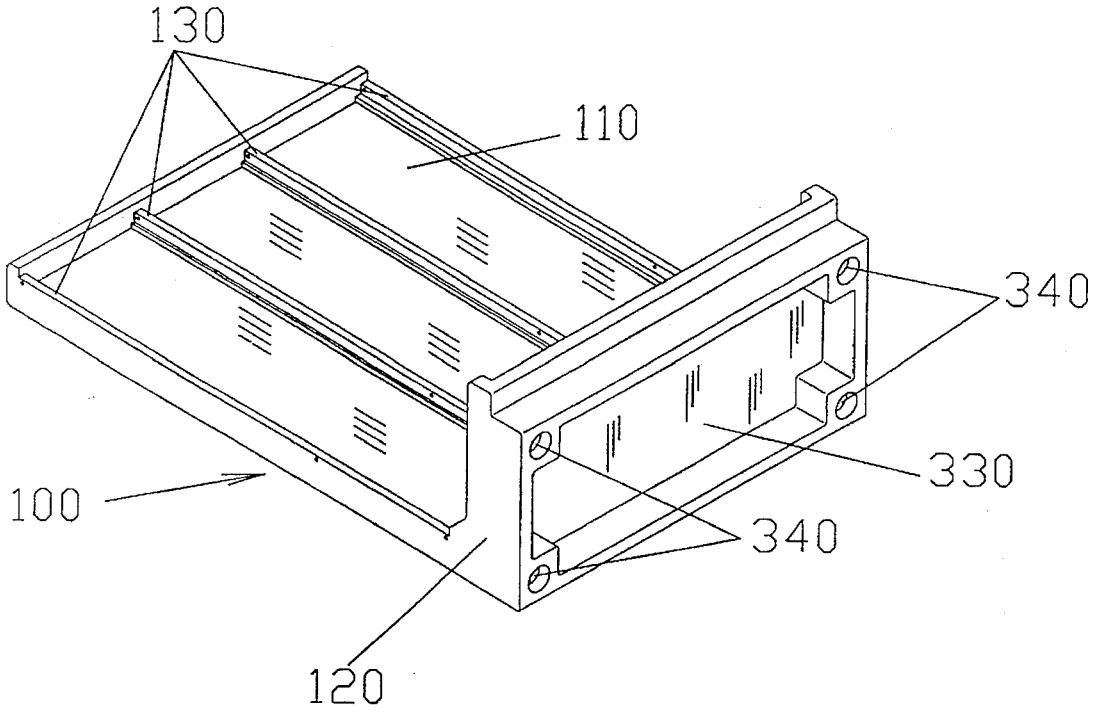
FIG. 3 shows a bottom/side isometric view of one embodiment of a single gondola unit.

FIG. 3 shows a bottom/side isometric view of one embodiment of a single gondola unit 100. The initial description is the same as for FIG. 1. Additionally, adjustable footings 340 are threadably attached to a bottom portion of horizontal panel 120. By rotating the threaded footings 340 to different lengths the gondola 100 may be made stable even on uneven flooring. The bottom portion of horizontal panel 120 also contains integrally formed indent 330. Indent 330 provides structural strength to horizontal panel 120.

D. FIG. 4

Figure 4:
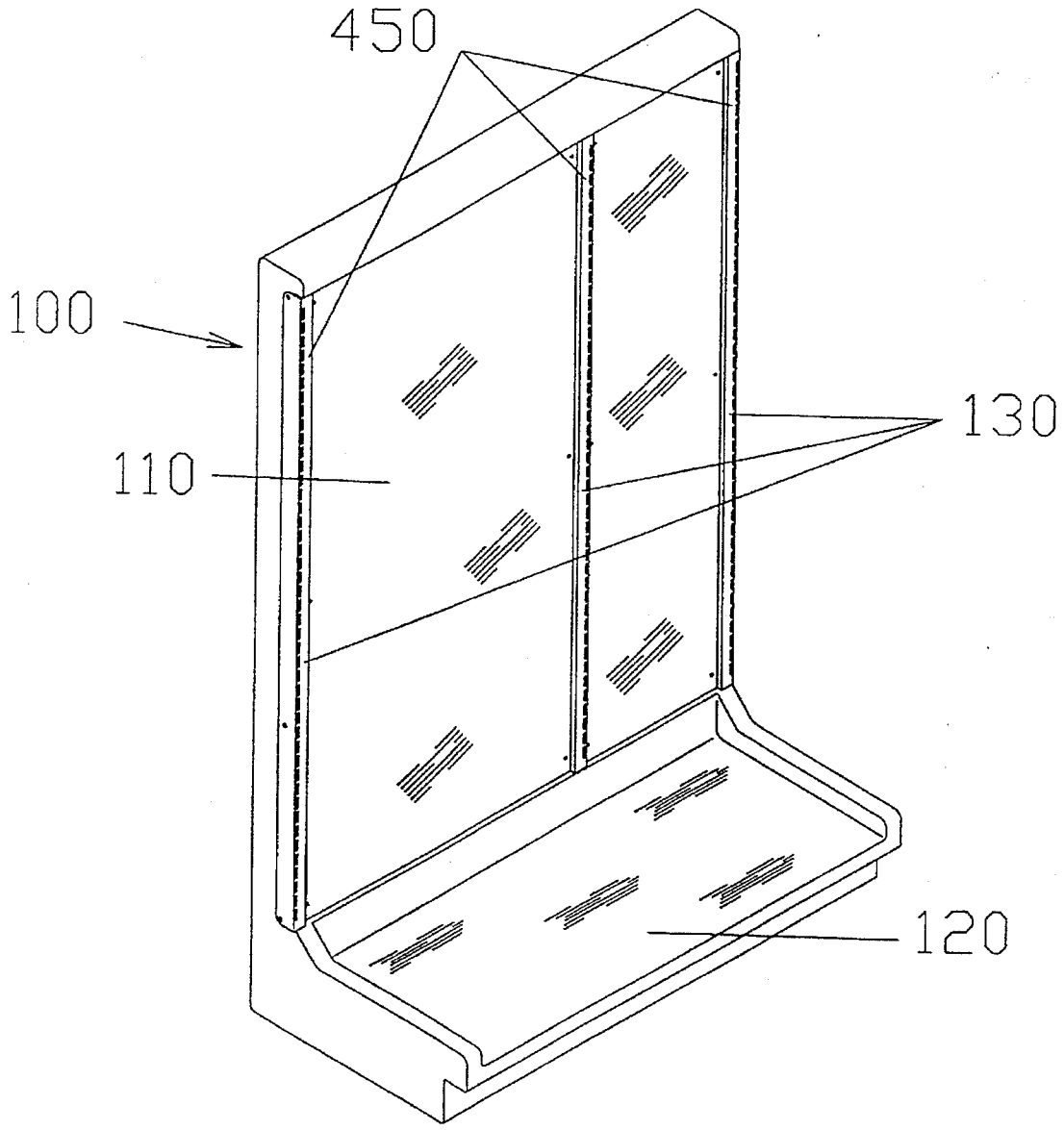
FIG. 4 shows a front/side isometric view of one embodiment of a single gondola unit having shelving support members attached to the vertical ribs.

FIG. 4 shows a front/side isometric view of one embodiment of a single gondola unit 100. The description is the same as for FIG. 1 except that shelving support members 450 are fixedly attached to vertical ribs 130 (not visible since they are covered by shelving support members 450).

E. FIG. 5

Figure 5:
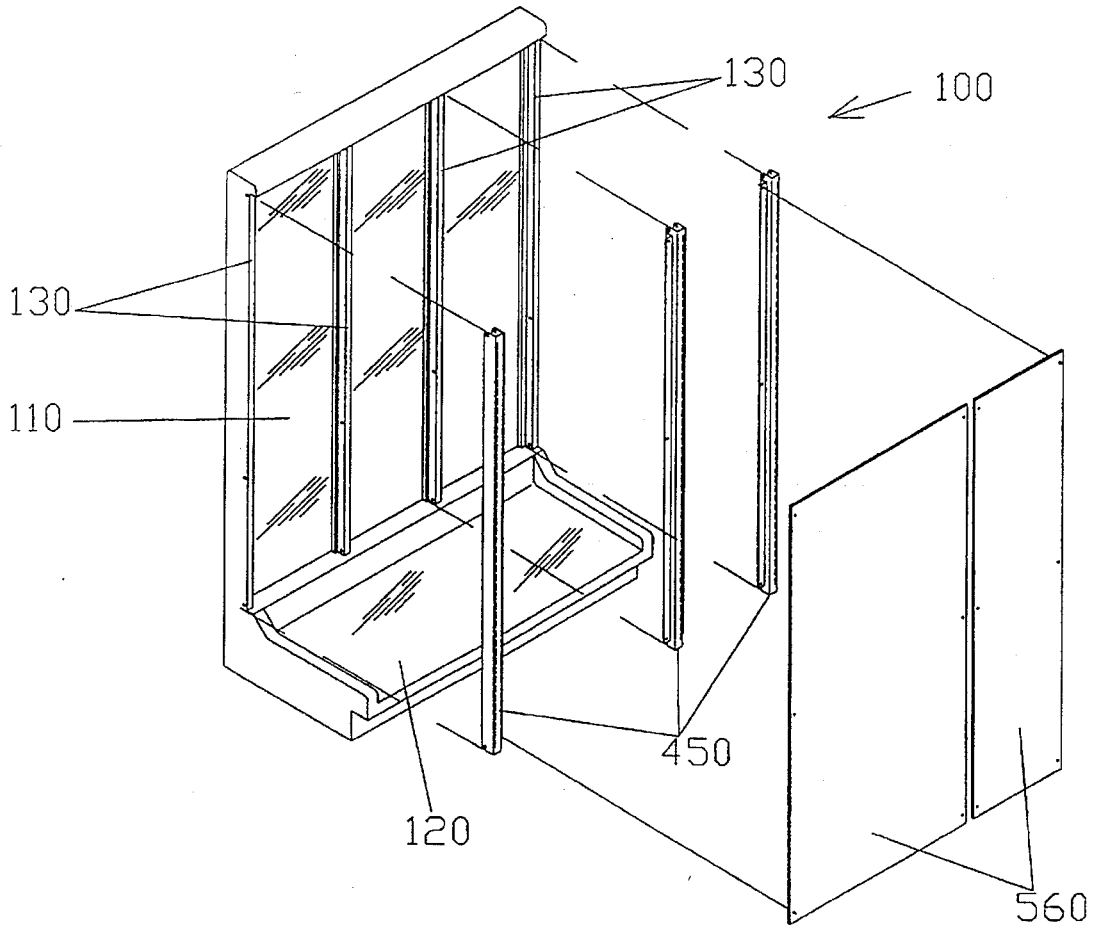
FIG. 5 shows an exploded front/side isometric view of one embodiment of a single gondola unit having shelving support members and peg board members attached to the vertical ribs.

FIG. 5 shows an exploded front/side isometric view of one embodiment a single gondola unit 100 having shelving support members 450 attached to vertical ribs 130. The description is the same as for FIG. 4 except that peg board members 560 are attached to flanges 455 which are fixedly attached to shelving support members 450.

F. FIG. 6

Figure 6:
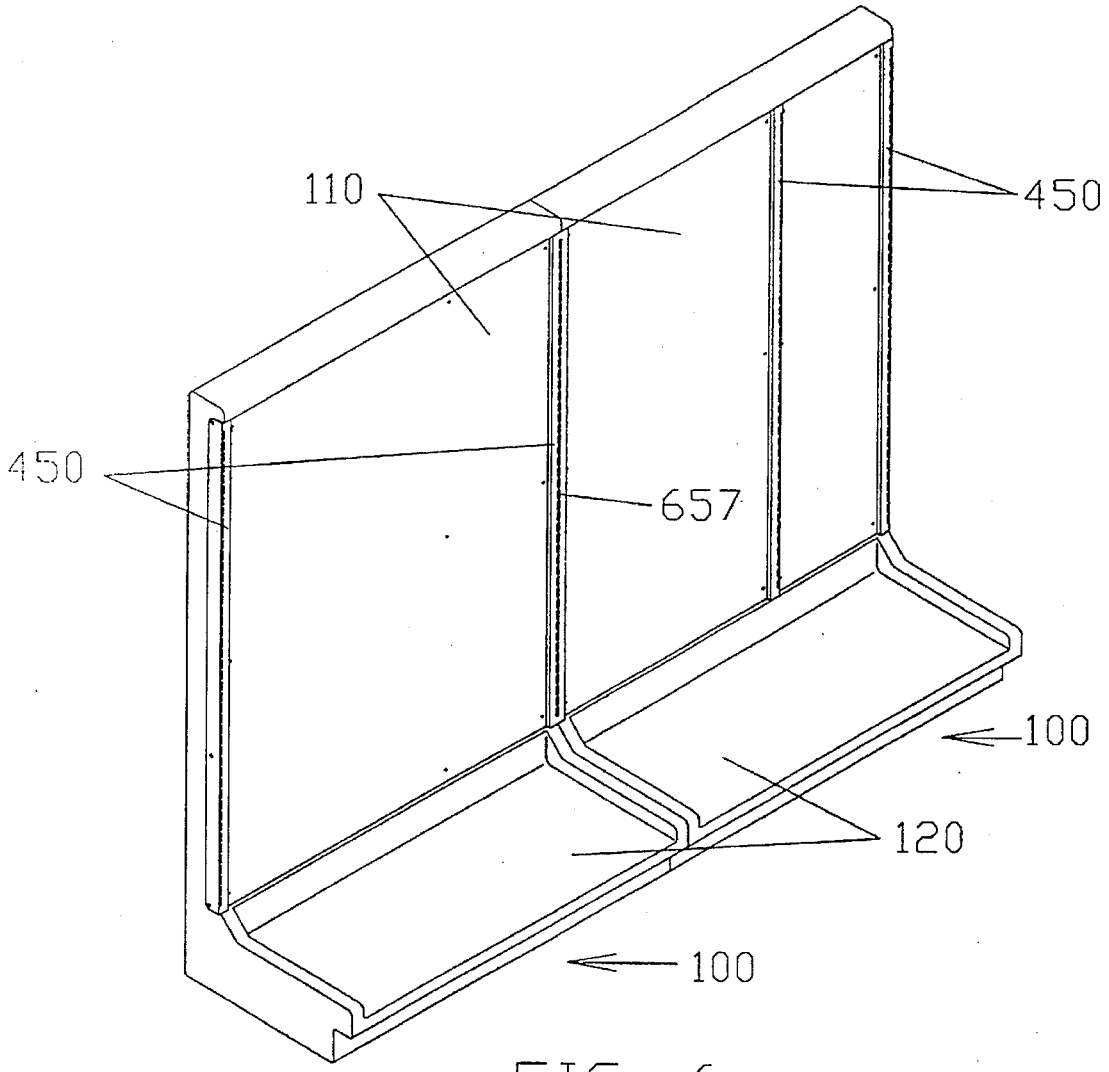
FIG. 6 shows a front/side isometric view of one embodiment of two gondola units abutted side-by-side having shelving support members attached to the vertical ribs.

FIG. 6 shows a front/side isometric view of one embodiment of two gondola units 100 abutted side-by-side. The description is the same as for FIG. 4 except that shared shelving support member 657 is fixedly attached over both abutting ribs 130 (not visible) of the two gondola units 100. This shared support member 657 is typically about twice as wide as standard shelving support members 450 and additionally serves to fixedly attach the two gondola units side-by-side.

Figure 7C:
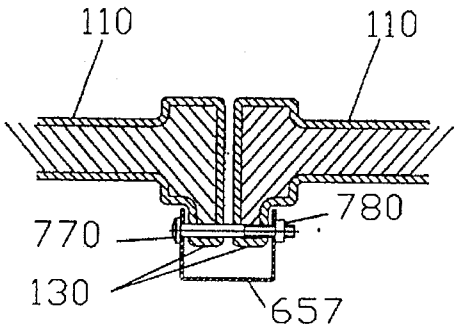
FIGS. 7A, 7B, and 7C show top cross-section views of three embodiments of the shelf support members attached to the vertical ribs.
Figure 7B:
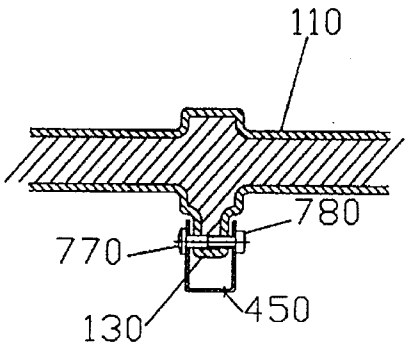
Figure 7A:
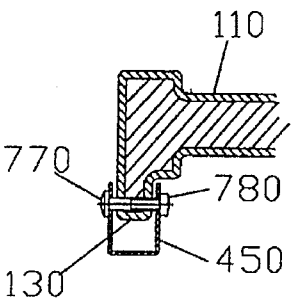

G. FIGS. 7A, 7B, and 7C

FIGS. 7A, 7B, and 7C show top cross-sectional views of three embodiments of the shelf support members attached to the vertical ribs 130. In FIGS. 7A and 7B, shelving support member 450 is removably attached to single rib 130 by bolt member 770 and nut member 780. In FIG. 7C shared shelving support member 657 is attached to ribs 130 of two gondola units.

Figure 8A:
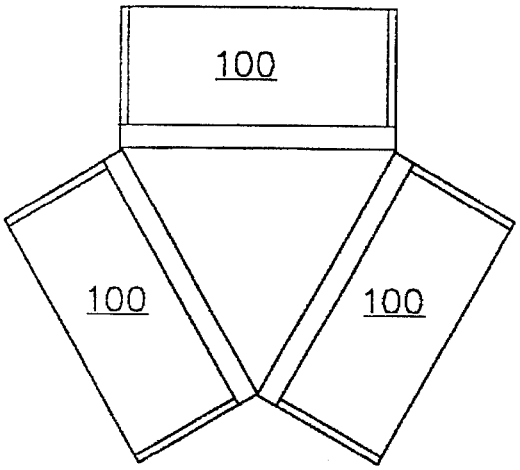
FIG. 8A shows a plan view of one embodiment of three gondola units abutted at the back portion of the side portions in a triangular assembly.
Figure 8B:
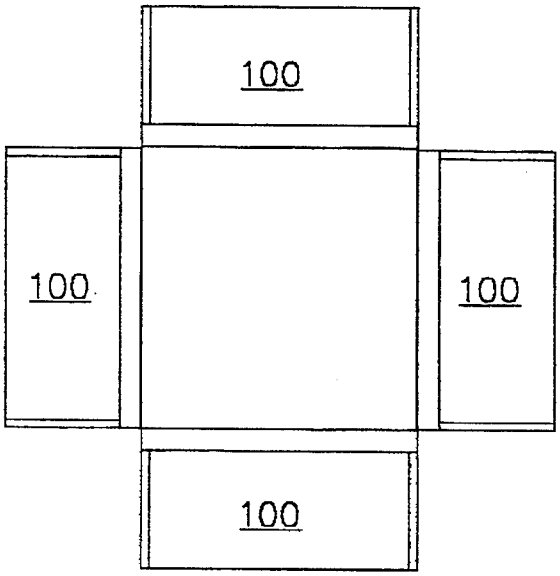
FIG. 8B shows a plan view of one embodiment of four gondolas units abutted at the back portion of the side portions in a square assembly.
Figure 8C:
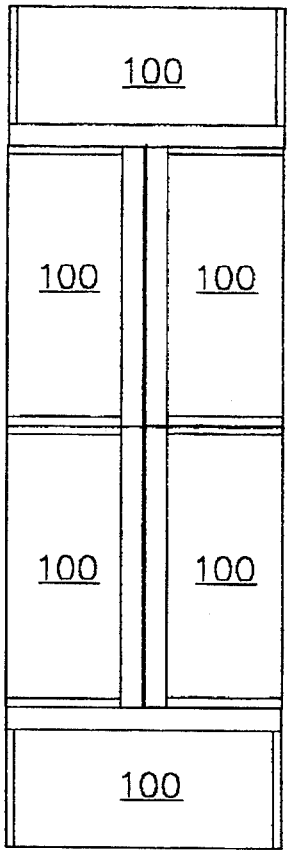
FIG. 8C shows a plan view of one embodiment of two gondola units abutted back-to-back and one gondola abutted perpendicularly to the each side of the back-to-back gondolas.

H. FIGS. 8A, 8B, and 8C

FIGS. 8A, B, and C show various possible arrangements of multiple gondola units. FIG. 8A shows a top view of one embodiment of three gondolas units abutted at the back portion of the side portions in a triangular assembly. FIG. 8B shows a top view of one embodiment of four gondolas units abutted at the back portion of the side portions in a square assembly. FIG. 8C shows a top view of one embodiment of two gondola units abutted back-to-back and one gondola abutted perpendicularly to each side of the back-to-back gondolas. The arrangements in FIGS. 8A and B allow for a storage space in the open middle of the triangle or square, respectively.

I. FIG. 9

Figure 9:
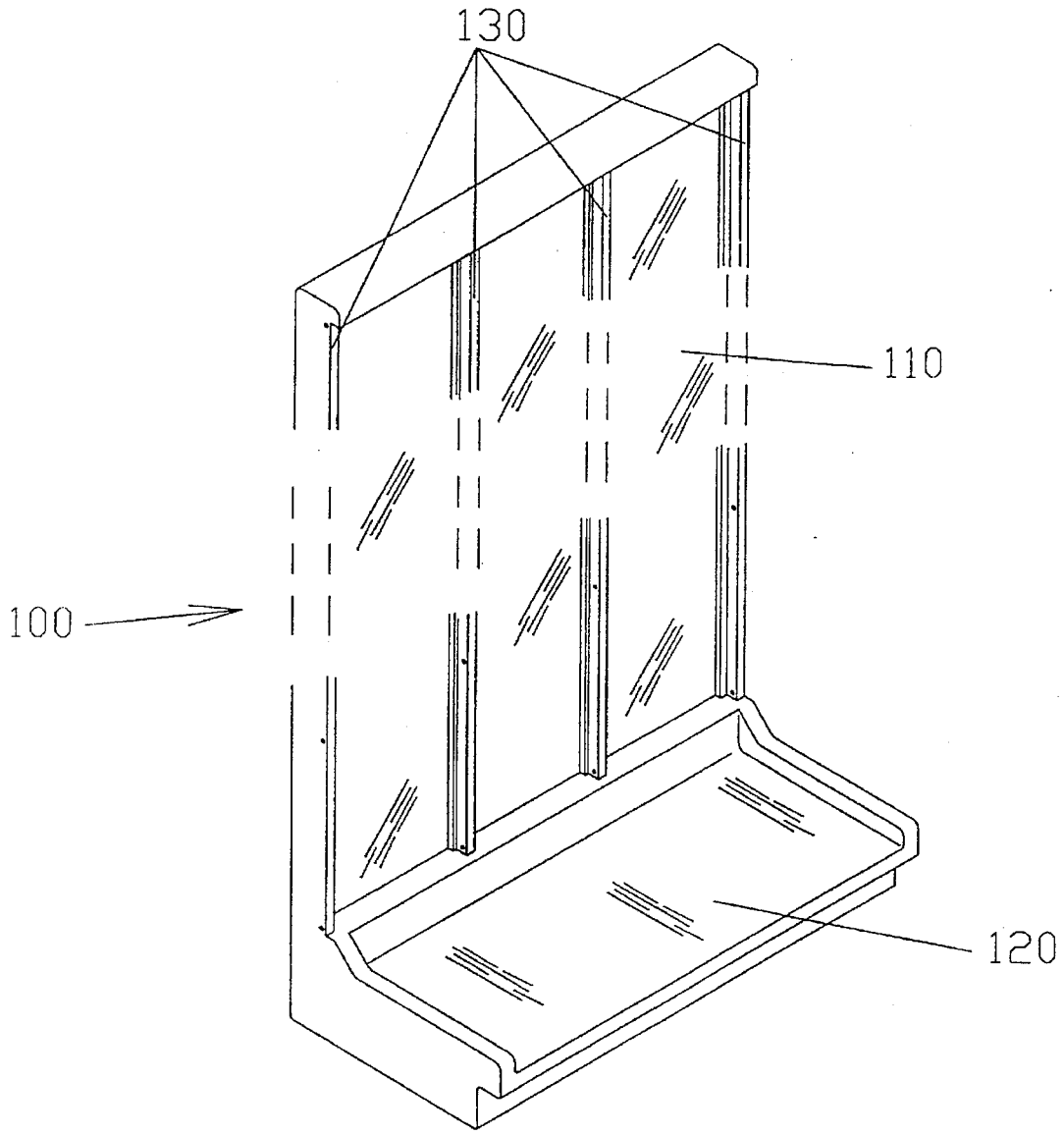
FIG. 9 shows an isometric front view of one embodiment of a gondola which has a truncated vertical panel.

FIG. 9 shows an isometric front view of one embodiment of a gondola which has a truncated vertical panel. The top portion of the vertical panel is truncated by cutting or sawing or any other conventional means to fit the gondola in locations having limited vertical space or where it is undesirable to block the view of a window.

What is claimed is:

1. A gondola assembly for storage of supplies or retail stock, said gondola assembly comprising at least two gondola units a. wherein said gondola units are adjoined side by side;

b. wherein one side of one gondola unit abuts one side of the adjoined gondola unit, and c. wherein each gondola unit comprises:

(1) an inner polymeric panel surface;

(2) an outer polymeric panel surface;

(3) wherein said inner and outer panel surfaces are integrally joined and formed by molding;

(4) wherein said inner and outer panel surfaces are separated by a distance of from about 0.5 inch to about one inch;

(5) wherein said inner panel surface is substantially parallel to the corresponding outer panel surface;

(6) wherein said inner and outer panel surfaces form a plurality of integrally joined panels;

(7) wherein said joined panels comprise:

(a) a substantially vertical panel from about 48 inches to about 60 inches in height and about 30 inches to about 42 inches in width, having a top and bottom portion, having a front and back portion, said front portion adapted to receive shelves or hooks for displaying or storing supplies or retail goods; and (b) a substantially horizontal panel from about 12 inches to about 24 inches in depth and from about 30 inches to about 42 inches in width, having a front and back portion, and having a top and bottom portion, said bottom portion for contacting a floor;

i) wherein said bottom portion of said horizontal panel contains integral indentations for providing structural strength to said horizontal panel;

(8) wherein said bottom portion of said vertical panel is integrally joined with said back portion of said horizontal panel, thus forming an L-shaped assembly;

(9) four leveling feet threadably attached to said bottom portion of said horizontal panel for leveling said gondola unit on an uneven flooring;

(10) wherein said vertical panel further comprises at least four integrally formed ribs, said ribs extending vertically from a top portion to a bottom position of said vertical panel, said ribs for providing structural strength to said vertical panel; and

(11) metal shelving support members fixedly attached to front portions of said ribs for receipt of shelf braces.

2. A gondola assembly for display of supplies or retail stock, said gondola assembly comprising at least two gondola units:

a. wherein said gondola units are abutted side by side; and b. wherein one side of one gondola unit abuts one side of the abutted gondola unit, and c. wherein each gondola unit comprises:

(1) an inner polymeric panel surface;

(2) an outer polymeric panel surface;

(3) wherein said inner and outer panel surfaces are integrally joined and formed by molding;

(4) wherein said inner and outer panel surfaces form a plurality of integrally joined panels;

(5) wherein said joined panels comprise:

(a) a substantially vertical panel having a top and bottom portion, and having a front and back portion, the front portion adapted to receive shelves or hooks for displaying or storing supplies or retail goods;

(b) a substantially horizontal panel having a front and back position, and having a top and bottom portion, said bottom portion for contacting a floor;

(6) wherein said bottom portion of said vertical panel is integrally joined with said back portion of said horizontal panel, thus forming an L-shaped assembly;

(7) wherein said vertical panel further comprises a plurality of integrally formed ribs extending vertically from a top portion to a bottom portion of said vertical panel for providing structural strength to said vertical panel and further comprising shelving support members fixedly attached to said ribs wherein said shelving support members further comprise integral flanges and said gondola assembly further comprising a peg board fixedly attached to said flanges.

3. A gondola assembly for display of supplies or retail stock, said gondola assembly comprising at least two gondola units:

a. wherein said gondola units are abutted side by side; and b. wherein one side of one gondola unit abuts one side of the abutted gondola unit, and c. wherein each gondola unit comprises:
(1) an inner polymeric panel surface;
(2) an outer polymeric panel surface;
(3) wherein said inner and outer panel surfaces are integrally joined and formed by molding;
(4) wherein said inner and outer panel surfaces form a plurality of integrally joined panels;
(5) wherein said joined panels comprise:
(a) a substantially vertical panel having a top and bottom portion, and having a front and back portion, said front portion configured to receive shelves or hooks for displaying or storing supplies or retail goods;
(b) a substantially horizontal panel having a front and back portion, and having a top and bottom portion, said bottom portion for contacting a floor;
(6) wherein said bottom portion of said vertical panel is integrally joined with said back portion of said horizontal panel, thus forming an L-shaped assembly;
(7) wherein said vertical panel further comprises a plurality of integrally formed ribs, said ribs extending vertically from a top portion to a bottom portion of said vertical panel for providing structural strength to said vertical panel and further comprising shared shelving support members fixedly attached to said ribs of said gondolas, for shelving support and for fixedly attaching said abutted gondola units.

4. A molded gondola unit for storage of supplies or retail stock, said gondola unit comprising:
a. an inner polymeric panel surface;
b. an outer polymeric panel surface;
c. wherein said inner and outer panel surfaces are integrally joined and formed by molding;
d. wherein said inner panel surface is substantially parallel to the corresponding outer panel surface;
e. wherein said inner and outer panel surfaces form a plurality of integrally joined panels, said joined panels comprising
(1) a substantially vertical panel having a top and bottom portion and a front and back portion, said front portion adapted to receive shelves or hooks for displaying or storing supplies or retail goods;
(2) a substantially horizontal panel having a front and back portion and a top and bottom portion, said bottom portion for contacting a floor;
(a) wherein said bottom portion of said horizontal panel contains integral indentations for providing structural strength to said horizontal panel;
f. wherein said bottom portion of said vertical panel is integrally joined with said back portion of said horizontal panel, thus forming an L-shaped assembly; and
g. wherein said vertical panel further comprises at least one integrally formed rib extending vertically from a top portion to a bottom portion of said vertical panel, said rib for providing structural strength to said vertical panel;
wherein said gondola unit is formed by molding and wherein said inner and outer panel surfaces are separated by a distance of from about 0.5 inch to about one inch; and
further comprising leveling means threadably attached to a lower portion of said horizontal panel for leveling said gondola assembly on an uneven flooring.

5. A molded gondola unit for storage of supplies or retail stock, said gondola unit comprising:
a. an inner polymeric panel surface;
b. an outer polymeric panel surface;
c. wherein said inner and outer panel surfaces are integrally joined and formed by molding;
d. wherein said inner panel surface is substantially parallel to the corresponding outer panel surface;
e. wherein said inner and outer panel surfaces form a plurality of integrally joined panels and wherein said joined panels comprise:
(1) a substantially vertical panel having a top and bottom portion and a front and back portion, said front portion adapted to receive shelves or hooks for displaying or storing supplies or retail goods; and
(2) a substantially horizontal panel having a front and back portion, and a top and bottom portion, said bottom portion for contacting a floor;
(a) wherein said bottom portion of said horizontal panel contains integral indentations for providing structural strength to said horizontal panel;
f. wherein said bottom portion of said Vertical panel is integrally joined with said back portion of said horizontal panel, thus forming an L-shaped assembly;
g. wherein said vertical panel further comprises at least one integrally formed rib extending vertically from a top portion to a bottom portion of said vertical panel, said rib for providing structural strength to said vertical panel;
wherein said gondola unit is formed by molding and wherein said inner and outer panel surfaces are separated by a distance of from about 0.5 inch to about one inch;
further comprising leveling means threadably attached to a lower portion of said horizontal panel for leveling said gondola assembly on an uneven flooring; and
further comprising shelving support members fixedly attached to the front portion of said ribs for receipt of shelf braces.

6. A molded gondola unit for storage of supplies or retail stock, said gondola unit comprising:
a. an inner polymeric panel surface;
b. an outer polymeric panel surface;
c. wherein said inner and outer panel surfaces are integrally joined and formed by molding;
d. wherein said inner panel surface is substantially parallel to the corresponding outer panel surface;
e. wherein said inner and outer panel surfaces form a plurality of integrally joined panels and wherein said joined panels comprise:
(1) a substantially vertical panel having a top and bottom portion and a front and back portion, said front portion adapted to receive shelves or hooks for displaying or storing supplies or retail goods; and
(2) a substantially horizontal panel having a front and back portion, and a top and bottom portion, said bottom portion for contacting a floor;
(a) wherein said bottom portion of said horizontal panel contains integral indentations for providing structural strength to said horizontal panel;
wherein said bottom portion of said vertical panel is integrally joined with said back portion of said horizontal panel, thus forming an L-shaped assembly;
g. wherein said vertical panel further comprises at least one integrally formed rib extending vertically from a top portion to a bottom portion of said vertical panel, said rib for providing structural strength to said vertical panel;

wherein said gondola unit is formed by molding and wherein said inner and outer panel surfaces are separated by a distance of from about 0.5 inch to about one inch; further comprising leveling means threadably attached to a lower portion of said horizontal panel for leveling said gondola unit on an uneven flooring;

further comprising a shelving support member fixedly attached to the front portion of said rib for receipt of shelf braces; and further comprising a shelving support member fixedly attached to said rib of said gondola, for shelving support.

7. A molded gondola unit for storage of supplies or retail stock, said gondola unit comprising:

a. an inner polymeric panel surface;

b. an outer polymeric panel surface;

c. wherein said inner and outer panel surfaces are integrally joined and formed by molding;

d. wherein said inner panel surface is substantially parallel to the corresponding outer panel surface;

e. wherein said inner and outer panel surfaces form a plurality of integrally joined panels and wherein said panels comprise:

(1) a substantially vertical panel having a top and bottom portion and a front and back portion, said front portion adapted to receive shelves or hooks for displaying or storing supplies or retail goods;

(2) a substantially horizontal panel having a front and back portion, and a top and bottom portion, said bottom portion for contacting a floor;

(a) wherein said bottom portion of said horizontal panel contains integral indentations for providing structural strength to said horizontal panel;

f. wherein said bottom portion of said vertical panel is integrally joined with said back portion of said horizontal panel, thus forming an L-shaped assembly;

g. wherein said vertical panel further comprises at least one integrally formed rib extending vertically from a top portion to a bottom portion of said vertical panel, said rib for providing structural strength to said vertical panel;

wherein said gondola unit is formed by molding and wherein said inner and outer panel surfaces are separated by a distance of from about 0.5 inch to about one inch;

further comprising leveling means threadably attached to a lower portion of said horizontal panel for leveling said gondola unit on an uneven flooring;

further comprising a shelving support member fixedly attached to the front portion of said rib for receipt of shelf braces; and wherein said shelving support member further comprises integral flanges and said gondola unit further comprises a peg board fixedly attached to said flanges.

* * * * *